US006725753B2

(12) United States Patent
Bell

(10) Patent No.: US 6,725,753 B2
(45) Date of Patent: Apr. 27, 2004

(54) DISPENSER FOR ROLLED MATERIAL

(76) Inventor: Clinton C. Bell, 4902 Torrey Pines Ct., Charlotte, NC (US) 28226-7924

( * ) Notice: Subject to any disclaimer, the term of this patent is extended or adjusted under 35 U.S.C. 154(b) by 0 days.

(21) Appl. No.: 10/189,208

(22) Filed: Jul. 3, 2002

(65) Prior Publication Data

US 2004/0004101 A1 Jan. 8, 2004

(51) Int. Cl.[7] ..... B26D 7/14

(52) U.S. Cl. ..... 83/175; 83/649; 225/43; 225/93

(58) Field of Search ..... 225/1, 20, 22, 225/25, 34, 39, 42, 43, 46, 47, 66, 89, 93; 83/175, 649, 455, 610, 456, 454, 375, 378, 382, 387, 388, 389

(56) References Cited

U.S. PATENT DOCUMENTS

| | | | | | |
|---|---|---|---|---|---|
| 293,349 | A | | 2/1884 | Newbury | |
| 1,122,673 | A | | 12/1914 | Winter et al. | |
| 1,713,857 | A | | 5/1929 | Rapp | |
| 2,271,135 | A | | 1/1942 | Crebbs | |
| 2,474,076 | A | | 6/1949 | Thompson | |
| D155,271 | S | | 9/1949 | Collard et al. | |
| 2,633,396 | A | | 3/1953 | Kawecki | |
| 3,190,520 | A | | 6/1965 | Wyant | |
| 3,311,278 | A | * | 3/1967 | Brandon | 225/93 |
| 3,317,099 | A | * | 5/1967 | Solomon | 225/23 |
| 3,791,601 | A | * | 2/1974 | Broden | 242/419 |
| 3,792,770 | A | * | 2/1974 | Freeman | 242/160.4 |
| 4,196,647 | A | * | 4/1980 | Fish | 83/175 |
| 4,417,495 | A | * | 11/1983 | Gordon et al. | 83/175 |
| 4,488,466 | A | * | 12/1984 | Jones | 83/175 |
| 4,787,542 | A | * | 11/1988 | Ruff et al. | 225/1 |
| 4,832,271 | A | | 5/1989 | Geleziunas | |
| 5,107,732 | A | | 4/1992 | Hanmer | |
| 5,125,548 | A | | 6/1992 | Perrin et al. | |
| 5,620,128 | A | | 4/1997 | Dingman et al. | |

* cited by examiner

*Primary Examiner*—Boyer D. Ashley
(74) *Attorney, Agent, or Firm*—Woodard, Emhardt, Moriarty, McNett & Henry LLP

(57) ABSTRACT

A dispenser for holding and dispensing rolls of flexible material. A box or cabinet includes mounts for holding one or more rolls of flexible material. The front wall of the box has a blade fixedly mounted thereto and is recessed within a pressure plate contactable against a portion of the sheet to be removed and held on an anvil stop surface formed by roughed edges.

10 Claims, 7 Drawing Sheets

DISPENSER FOR ROLLED MATERIAL

BACKGROUND OF THE INVENTION

The present invention relates to a dispenser containing various rolls of material primarily used in the kitchen to cover or wrap food for storage. The focus is toward plastic shrink wrap and aluminum foil, the materials most commonly used for this purpose.

DESCRIPTION OF THE PRIOR ART

Plastic shrink wrap is proven to be a difficult material to dispense because its very purpose is to cling to itself and to stretch. Both of these characteristics pose serious difficulties in dispensing and cutting the desired length of material.

Extensive testing beginning with full rolls and dispensing them to their core indicates the plastic shrink wrap must be suspended from a core or spindle to satisfactorily unwind without sticking to itself or its enclosure and fouling itself. When attempting to cut, tear or shear plastic shrink wrap, its ability to stretch and be resilient requires special consideration.

A variety of dispensers are known for holding rolls of sheet material. For example, the U.S. Pat. No. 4,832,271 issued to Geleziunas discloses a rectangular container for holding the roll with the container having a bottom slot through which the leading edge of the sheet material may be pulled. The roll rests on the bottom and side wall of the dispenser allowing for the possible sticking of the thin sheet material to the dispenser walls. A conventional dispenser is disclosed in U.S. Pat. No. 5,620,128 for holding the roll of sheet material. A portion of the sheet material is pulled from the dispenser and then torn from the roll starting at one edge of the material and then progressing across the width of the material. Such tearing action allows for the potential of shrink wrap material to overlap it and cling to itself. Instead of the tearing action, what is needed is for the thin sheet to be pierced simultaneously across the width thereof thereby allowing the portion to be severed from the roll in such a manner to eliminate the clinging previously described.

Dispensers similar to the aforementioned dispensers that separate a portion of the seat from the roll by first tearing the sheet at one edge and then progressively tearing the sheet across its width are shown in the following U.S. Pat. Nos.: D155,271; 5,125,548; 2,474,076; 2,633,396; 1,713,857; 2,271,135; 3;190,520 and 1,122,673. Another approach is disclosed in the U.S. Pat. No. 293,349 issued to M. P. Newbury wherein a knife having multiple cutting points extends across the width of the sheet with the sheet then being pulled downwardly against the cutting points.

The invention disclosed herein overcomes the aforementioned difficulties. A cabinet is provided that may be attached under kitchen cabinets or to a wall. Multiple rolls of sheet material may be suspendedly mounted within the cabinet allowing the material to unwind freely. A cabinet door may be swung downwardly placing the sheet in a state of tension while piercing the sheet at multiple locations simultaneously across the width of the sheet allowing the sheet to be severed from the roll.

SUMMARY OF THE INVENTION

One embodiment of the present invention is a device for holding a roll of flexible sheet and for piercing the sheet to dispense a piece of the sheet from the roll. A sheet support has a sheet stop surface against which a piece of the sheet may be moved against once unrolled from the roll and while still attached to the roll. A blade is movable toward the sheet to contact the sheet simultaneously across the width of the sheet to pierce it and dispense a piece therefrom.

It is an object of the present invention to provide a new and improved dispenser for holding and dispensing sheet material from rolls.

A further object of the present invention is to provide a dispenser of shrink wrap sheet material that is severed from a roll minimizing overlapping and clinging of the severed sheet material.

An additional object of the present invention is to provide a new and improved method of storing a roll of thin plastic sheet and allowing a portion thereof to be severed by a blade at multiple locations simultaneously across the width of the sheet.

Related objects and advantageous of the present invention will be apparent from the following description.

DESCRIPTION OF THE PREFERRED EMBODIMENTS

Figure 1:
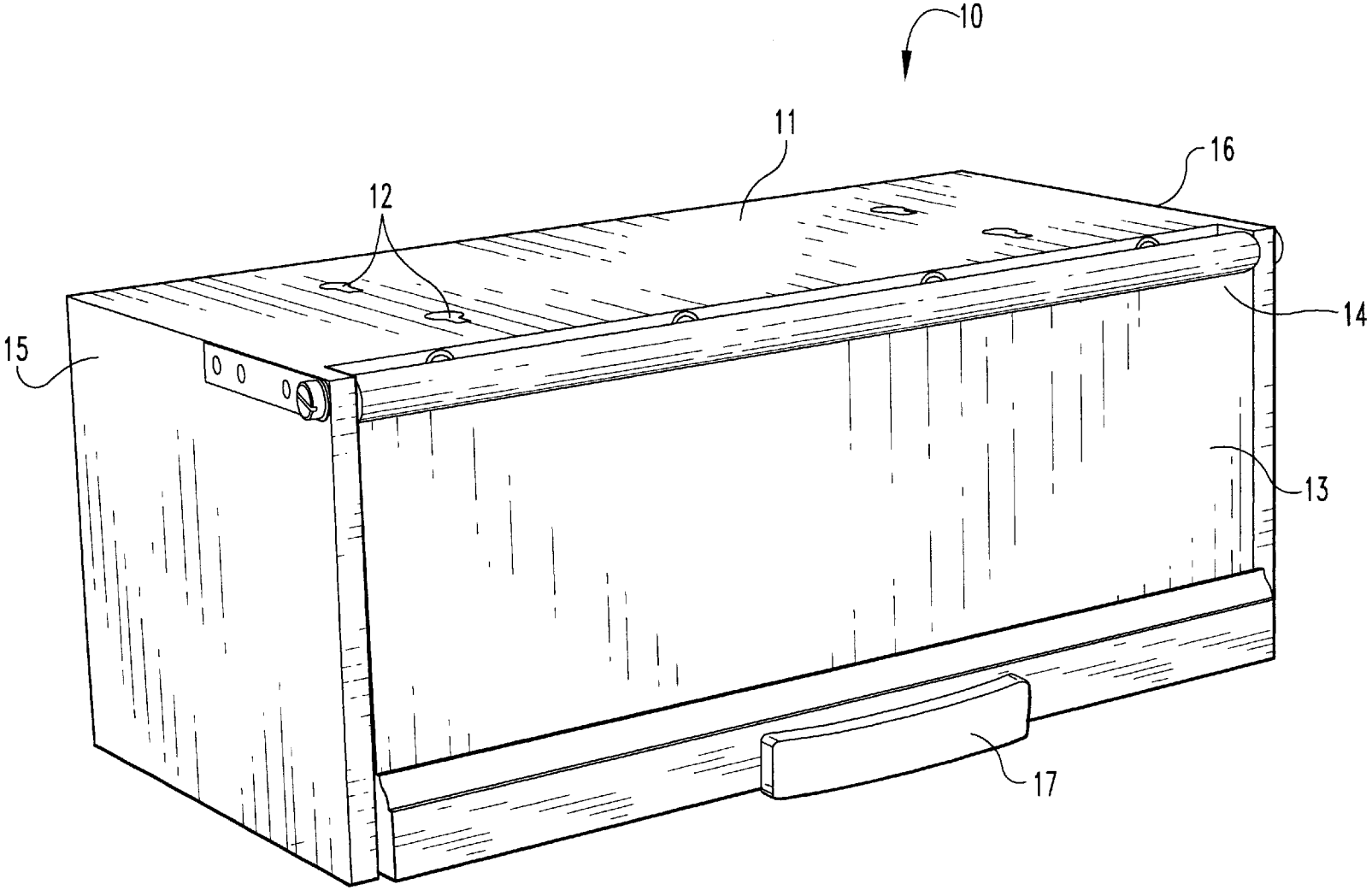
FIG. 1 is a perspective view of the preferred embodiment of the dispenser incorporating the present invention.

For the purposes of promoting an understanding of the principles of the invention, reference will now be made to the embodiments illustrated in the drawings and specific language will be used to describe same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now particularly to FIG. 1, there is shown dispenser 10 incorporating the present invention. The dispenser is a rectangular, six-sided box having a top wall 11 with the plurality of apertures 12 that may be utilized to hang the box beneath another wall, such as the bottom wall of a kitchen cabinet. Alternatively, the rear wall of the box may be provided with apertures through which conventional fastening devices may be utilized to mount the box to a vertical wall. Other types of fastening means may be utilized, such as fasteners mounted to the top wall and rear wall to facilitate the mounting thereof. The box forms a cabinet that may be made of any suitable material capable of storing, dispensing, cutting and shearing material. For example, the box may be produced from wood, plastic or metal.

Figure 2:
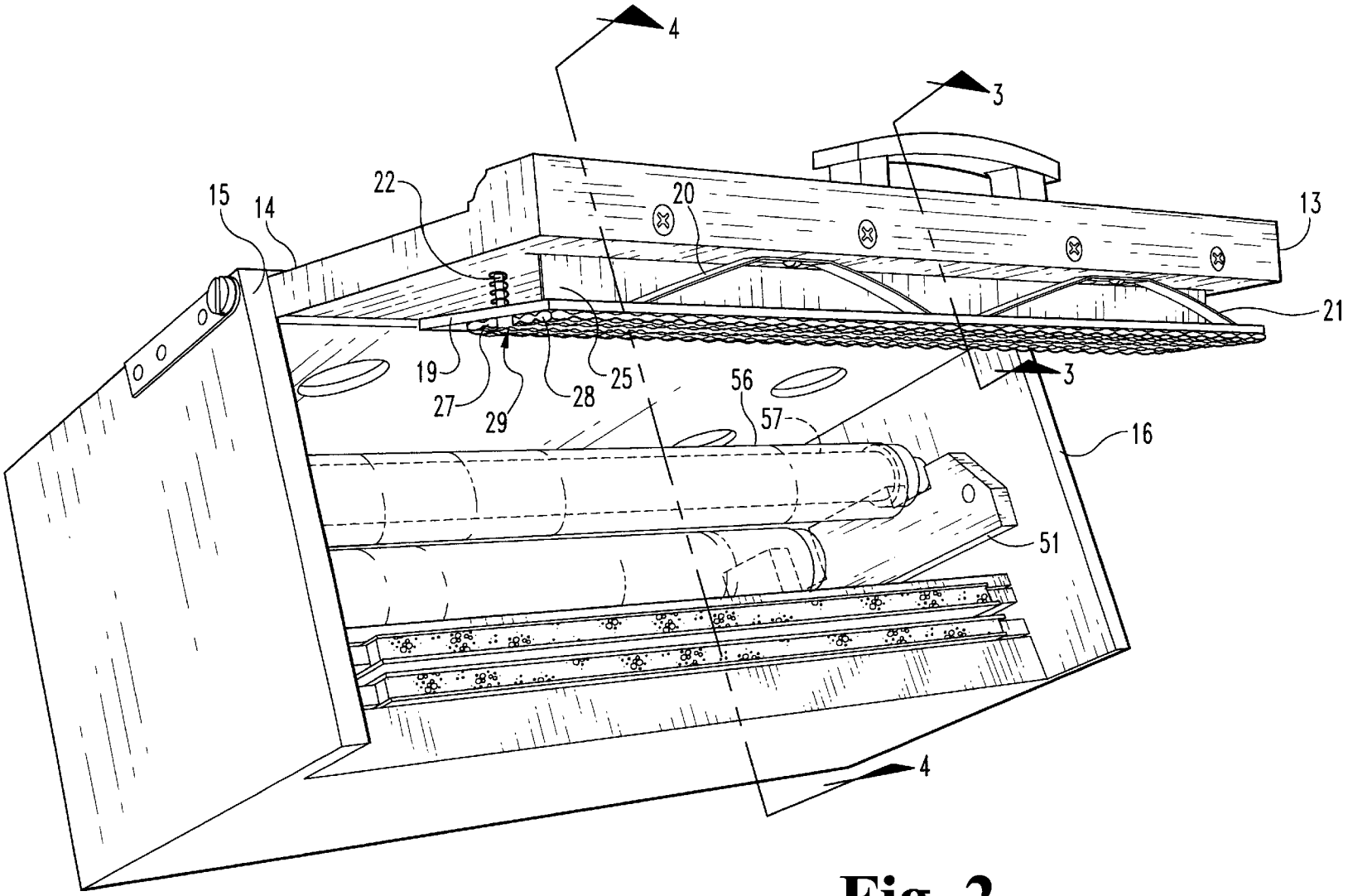
FIG. 2 is the same view as FIG. 1 only showing the dispenser front wall in the open position.

A front wall or door 13 has a top end 14 hingedly mounted to either the end walls or top wall. In the embodiment depicted in FIG. 1, the top portion 14 of wall 13 is pivotally mounted to and between the end walls 15 and 16. A plurality of spring biased detentes are captively mounted to top wall 11 and project outwardly into spherical recesses formed in the top edge of wall 13 in the known conventional manner. The recesses and detentes are arranged to allow wall 13 to be pivoted upward and remain in the open position illustrated in FIG. 2 until the handle 17 mounted to wall 13 is forced downwardly.

Figure 3:
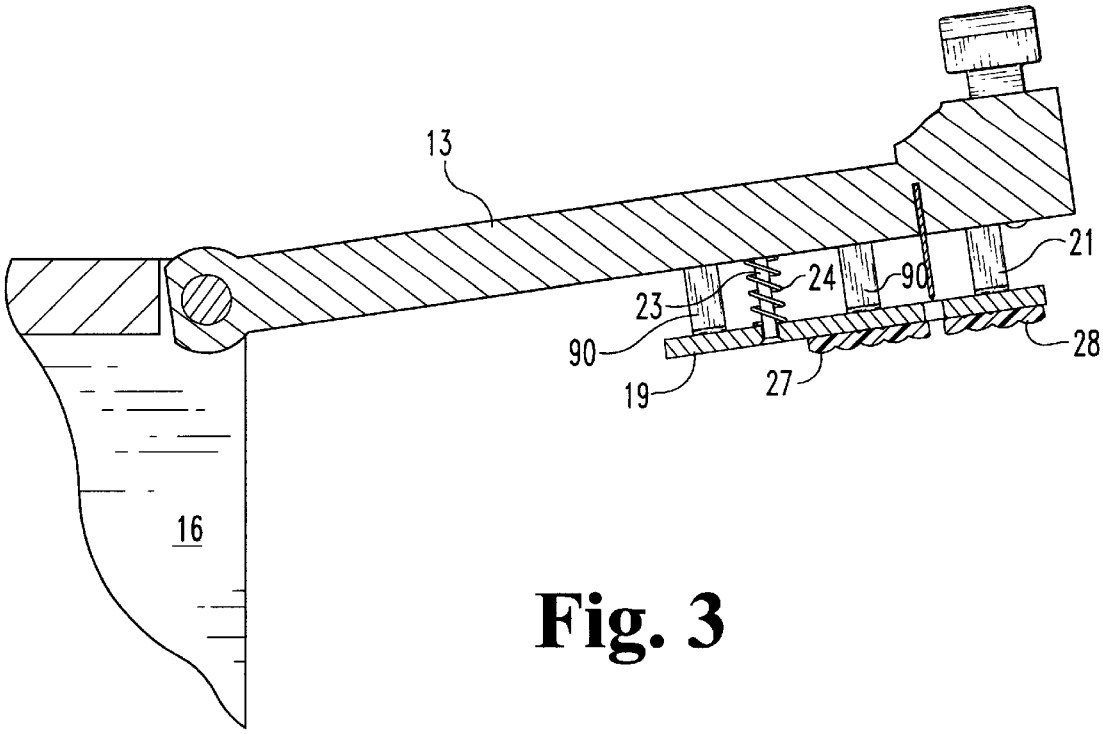
FIG. 3 is a cross-sectional view taken along the line 3—3 of FIG. 2 and viewed in the direction of the arrows.

A spring biased pressure plate 19 (FIG. 2) is mounted to front wall 13 and is positioned on the interior or inwardly facing surface of wall 13. A pair of leaf springs 20 and 21 are mounted to and between wall 13 and plate 19 with each leaf spring having a pair of distal ends contacting pressure plate 19 and normally urging the plate away from wall 13. Three additional springs 90 are fixedly mounted to wall 12 with each leaf spring having a pair of distal ends contacting pressure plate 19 and normally urging the plate away from the wall with slot 29 (FIG. 6) extending between the two springs 20/21 and the three springs 90. A pair of rods 22 (FIG. 2) and 23 (FIG. 3) have proximal ends fixed to wall 13 and opposite enlarged ends positioned on the outwardly facing surface of the pressure plate. Helical springs 24 surround screws 22 and 23 normally urging the pressure plate apart from wall 13. For example, rod 23 (FIG. 3) is fixedly secured to wall 13 and extends downwardly therefrom when the wall is in the open position. Rod 23 extends through pressure plate 19 and has an enlarged end positioned on the outwardly facing surface of the pressure plate thereby holding the pressure plate captive to wall 13. A helical spring 24 surrounds rod 23 normally urging the pressure plate 19 apart from wall 13 but yieldable to allow the pressure plate to move toward wall 13 when the leaf springs are compressed.

Figure 6:
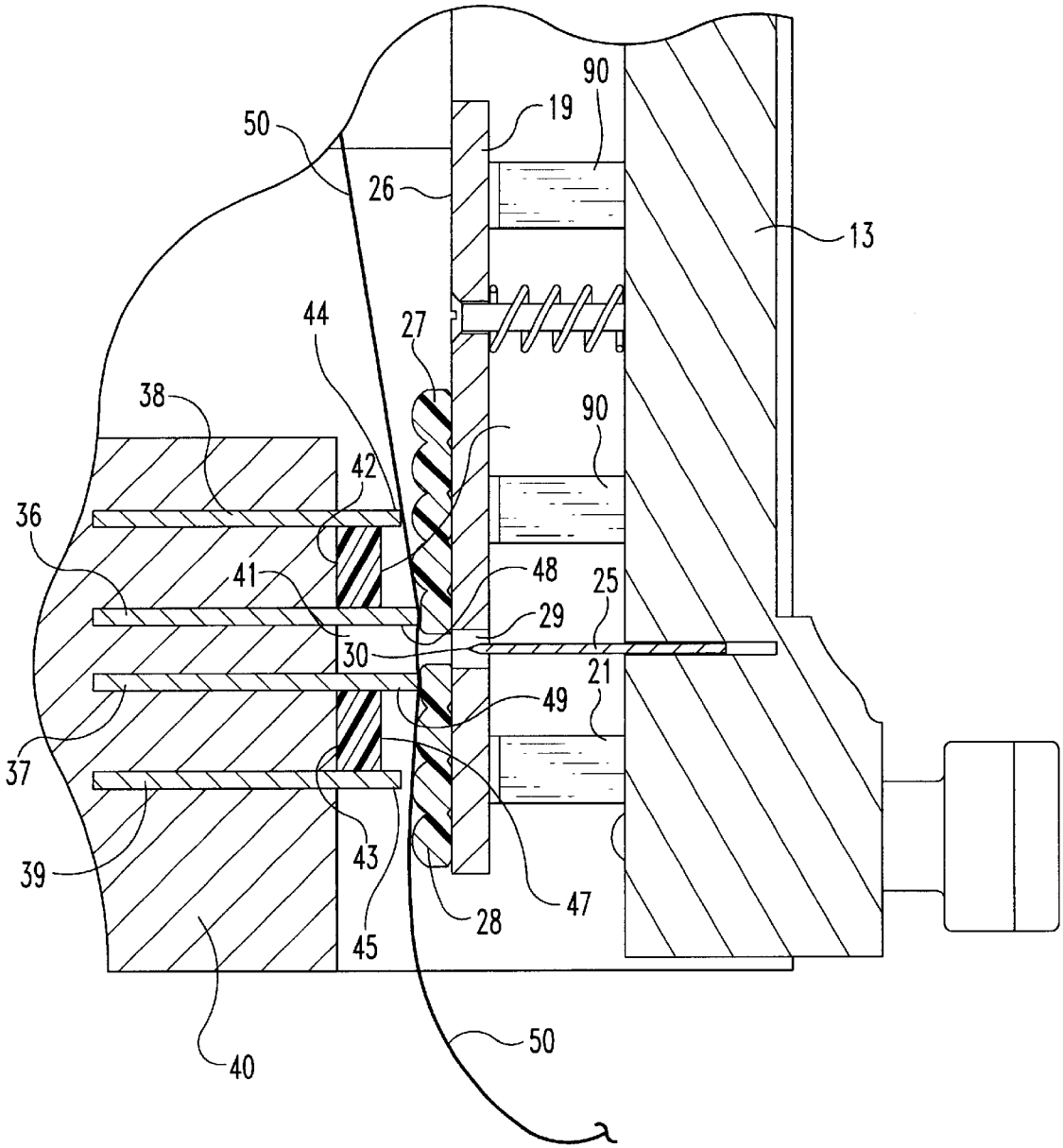
FIG. 6 is an enlarged cross-sectional view showing the pressure plate engaging the flexible sheet to be severed with the knife in the retracted position.

Blade 25 has a first end fixedly mounted to wall 13 and opposite distal end projectable through slot 29 extending across pressure plate 19. Fixedly mounted to the outwardly facing surface 26 (FIG. 6) of pressure plate 19 are a pair of strips 27 and 28 produced from a resilient material, such as foam, plastic or rubber. Slot 29 extends across the length of plate 19 and is located between strips 27 and 28 which are spaced apart allowing the pointed end 30 of blade 25 to extend through the slot and outwardly of strips 27 and 28. The helical springs surrounding rods 22 and 23 along with leaf springs 20/21/90 normally urge pressure plate 19 to the outward position as depicted in FIG. 6 thereby recessing the pointed end 30 of blade 25. In such a state, the pointed end may be recessed either within the slot formed by strips 27 or 28 or within slot 29. When wall 13 is pivoted to the downward position, strips 27 and 28 contact the bottom portion of the dispenser thereby compressing the strips with further inward movement of wall 13 causing the pointed end 30 to project outwardly of slot 29 and the slot formed between strips 27 and 28 piercing the sheet of flexible material extending outwardly from the dispenser.

Figure 7:
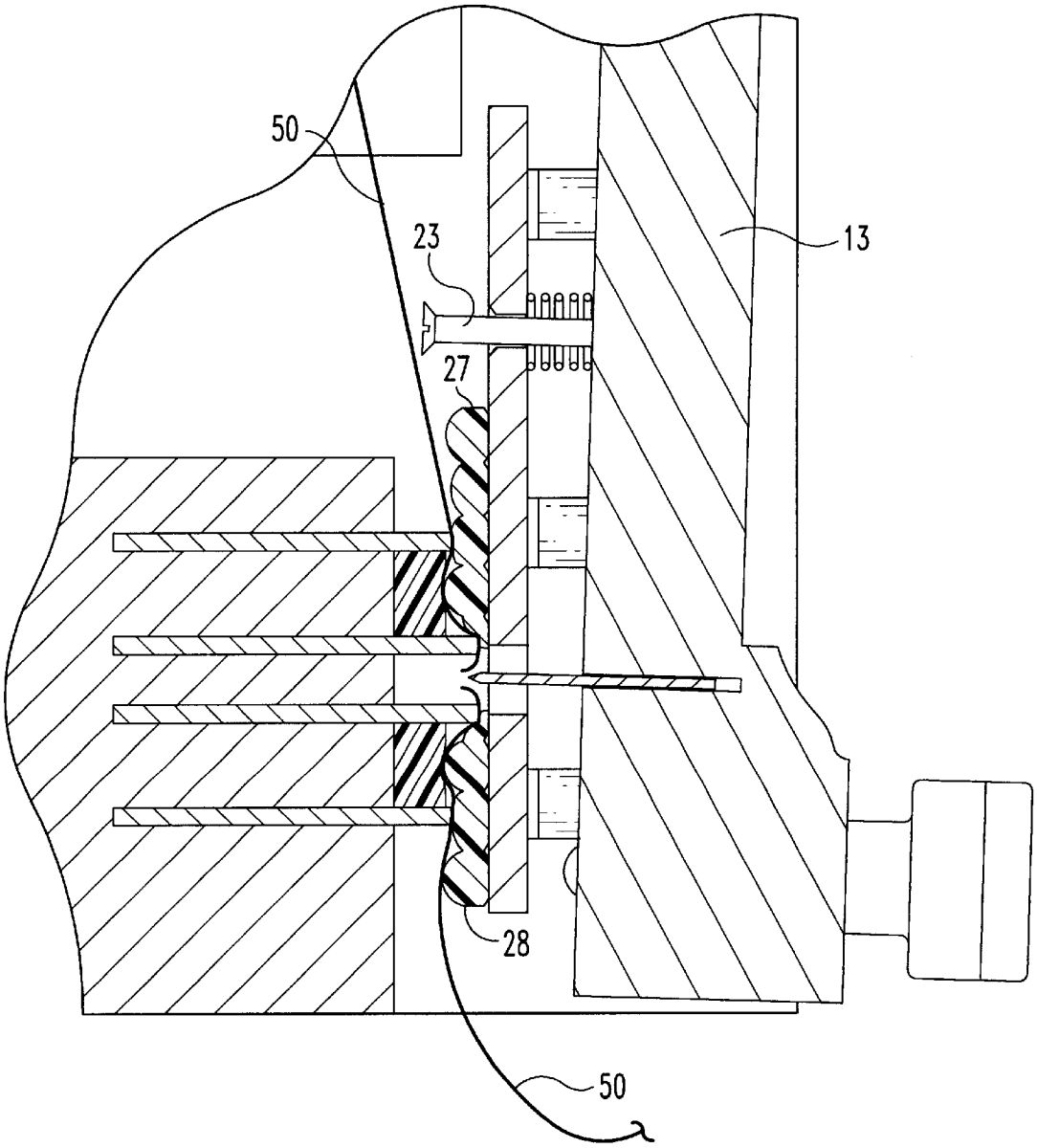
FIG. 7 is the same view as FIG. 6 only showing the knife extending outwardly from the pressure plate and through the flexible sheet.

A first pair of edges 36 and 37 are mounted to and between a second pair of edges 38 and 39, in turn, mounted to the bottom wall 40 of the dispenser. Edges 36 and 37 are spaced apart forming a slot 41 into which blade 25 projects when wall 13 is in the fully closed position compressing strips 27 and 28. A pair of resilient spacers 42 and 43 are mounted respectively between edges 36/38 and 37/39. The outer ends 44 and 45 of edges 38 and 39 are located inwardly of the outer ends 48 and 49 of edges 36 and 37. Ends 44 and 45 are located outwardly of surfaces 46 and 47. The sheet 50 of flexible material to be severed from the storage roll extends between the bottom portion of the dispenser and wall 13 when the wall is in the closed position. Initially, the outwardly facing surfaces of strips 27 and 28 contact sheet 50 holding the sheet against the outer ends 48 and 49 of edges or rulers 36 and 37. Continued movement of wall 13 toward the bottom portion of the dispenser causes resilient strips 27 and 28 to compress. Likewise, the helical springs surrounding rods 22 and 23 compress along with leaf springs 20/21/90 moving wall 13 further toward the bottom portion of the dispenser. The pointed ends 30 of blade 25 then extends outwardly of slot 29 and from within resilient strips 27 and 28 piercing strip 50 as illustrated in FIG. 7. Prior to cutting blade 25 extending outwardly from strips 27 and 28, resilient strips 27 and 28 force sheet 50 against surfaces 46 and 47 of resilient spacers 42 and 43 compressing the spacers to the extent that sheet 50 is also forced against ends 44 and 45 of edges 38 and 39 placing sheet 50 in tension with pointed end 30 of blade 25 then piercing sheet 50 in multiple locations across the width of the sheet.

Figure 5:
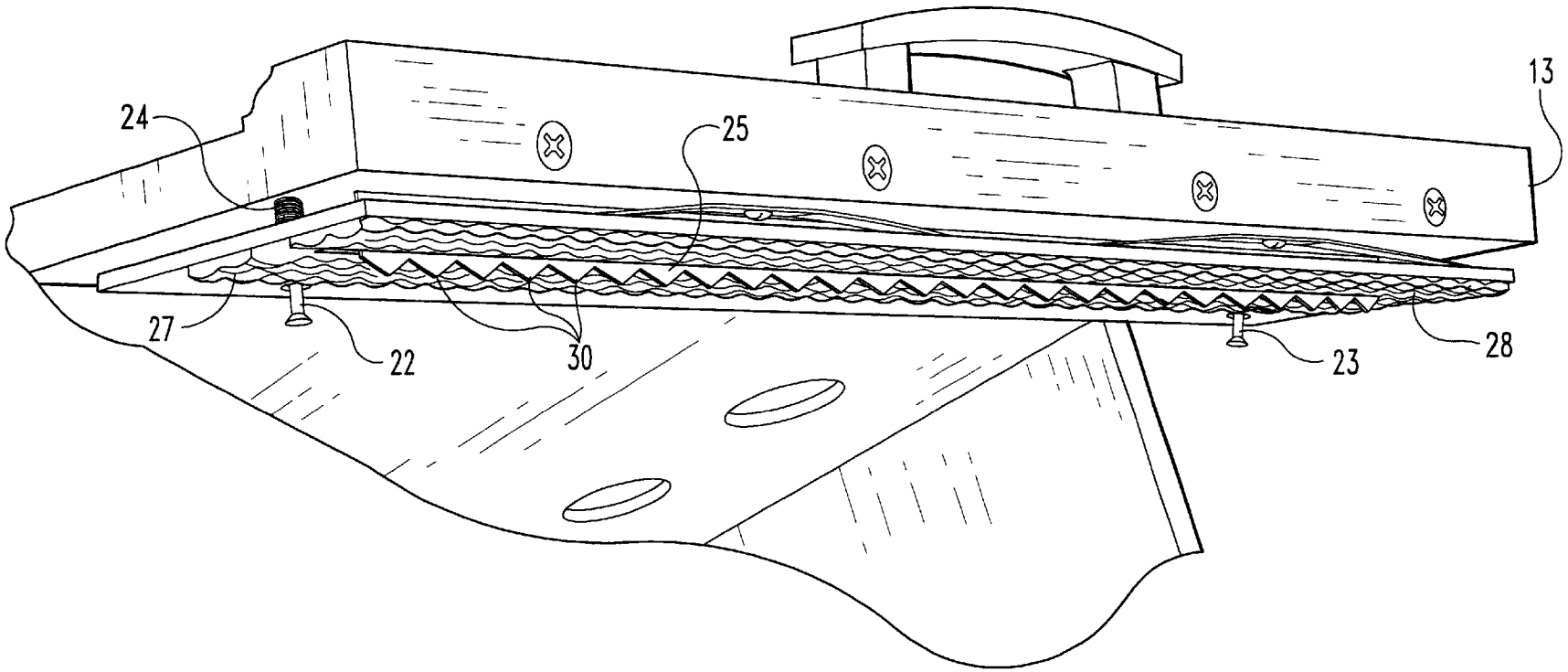
FIG. 5 is the same view as FIG. 2 only showing the cutting blade extending from the pressure plate.

As illustrated in FIG. 5, blade 25 includes a plurality of pointed ends 30 located along the length of the blade. The number of teeth per inch and the pitch of the landings between the points of the teeth help determine the amount of pressure required to pierce and sever the sheet material. More teeth per inch increases the required pressure to complete the cutting and severing function whereas fewer teeth per inch requires a cutting blade of greater depth thereby requiring greater movement of the cutting blade 25 into the cutting slot 41.

Figure 4:
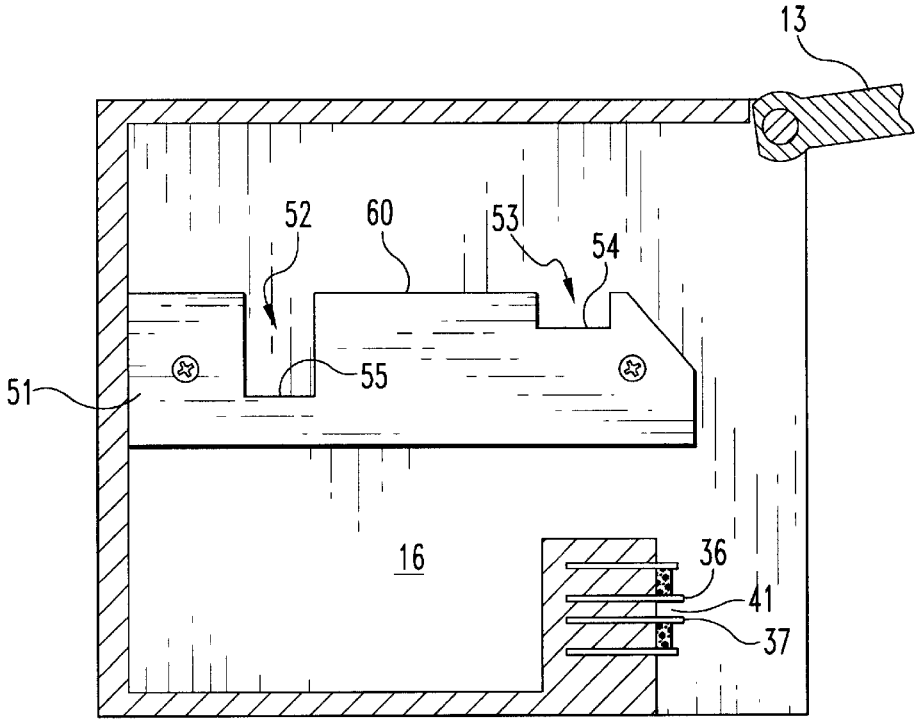
FIG. 4 is a cross-sectional view taken along the line 4—4 of FIG. 2 and viewed in the direction of the arrows.

The dispenser disclosed in the drawings is configured to receive two rolls of flexible material; however, it is to be understood that the present invention includes a dispenser for holding less than two and more than two rolls of flexible material. Mounted to the inside surface of each end wall 15 and 16 is a mount for removably receiving a spindle upon which is mounted the roll of flexible material. For example, mount 51 (FIG. 4) is configured as a spacing block to space the end of the rolls apart from the end wall 16. A pair of upwardly opening slots 52 and 53 are formed in mount 51. Edges 36 and 37 extending lengthwise on the opposite sides of slot 41 form a vertically extending stop surface against which the sheet of flexible material may rest. Thus, slot 52 is located a horizontal distance aft of the vertical stop surface formed by edges 36 and 37. Slot 52 is located a greater distance behind the vertical surface formed by edges 36 and 37 as compared to slot 53 thereby locating the roll of flexible material mounted to slot 52 a greater horizontal distance from edges 36 and 37 than the roll of flexible material mounted to slot 53. Likewise, the bottom edge 54 of slot 53 is located at a higher elevation or a greater vertical distance from slot 41 as compared to the bottom edge 55 of slot 52 thereby locating the roll of flexible material mounted to slot 53 at a higher elevation as compared to the roll of flexible material mounted to slot 52.

A spacing mount is mounted to the inside surface of wall 15 and is identical to mount 51 and has a pair of slots aligned with slots 52 and 54. Thus, a first roll of flexible material 56 (FIG. 2) may be removably mounted to a spindle 57, in turn, having its opposite ends received in the forward slots 53 of the mounts attached inwardly to end walls 15 and 16. Likewise, a second roll of flexible material is removably mounted to a second spindle, in turn, having its opposite ends removably mounted in slots 52 formed in the mounts attached to the interior surface of end walls 15 and 16. The top edge 60 (FIG. 3) of mount 51 is at the same elevation on either side of slot 52 and 53 thereby allowing each roll spindle to be installed initially on the same plane with the rear spindle dropping to a greater depth due to the depth of slot 52 as compared to slot 53.

In one embodiment, the first roll of flexible material mounted to the forward pair of slots 53 has shrink wrap or thin walled plastic sheet wound thereon whereas the second roll of flexible material movably mounted to slots 52 has metallic foil wrapped thereon. Thus, the distance of travel of the shrink-wrap material which has a tendency to cling to itself is mounted in the forward set of slots 53 minimizing the effect of the clinging tendency. On the other hand, the metallic foil mounted to the rear set of slots does not have tendency to cling to itself and thus may be located at a greater distance from the cutting blade. Further, the roll of shrink wrap material mounted to the forward slots is at a higher elevation as compared to the rearward metallic foil roll allowing the user to place his or her hand beneath the forward roll in order to grasp the metallic foil and pull the foil forwardly.

In order to sever a portion of the sheet wound on either roll mounted to slot 52 or 53, the leading edge of either sheet 50 is pulled forwardly and downwardly past slot 41. An anvil is formed by the first pair of edges 36–37, the second pair of edges 38–39 and the resilient spacers 42–43. The profile of such an anvil is important in achieving the needed stretching and tensioning of the sheet material to be severed by blade 25. The center slot 41 in the anvil is formed by the two edges 36 and 37 that have roughed distal ends 48 and 49 with a spacer located between edged 36 and 37 to keep the edges apart. The difference in the forward location of ends 48 and 49 as compared to ends 44 and 45 of edges 38 and 39 causes the sheet material resting across the ends to be stretched and tensioned when pressure plate 19 is compressed against ends 48–49 and 44–45. As the pressure plate 19 is further compressed, the cutting of blade 25 moves past plate 19 and enters into slot 41 in the anvil. As the cutting blade enters the slot 41, the blade first pierces and then shears the material. Since a plurality of pointed ends 30 (FIG. 5) are located across along the length of the blade and across the width of sheet 50, the blade pierces sheet 50 at multiple locations simultaneously across the width of the sheet allowing removal of the bottom portion of the sheet from the roll. That is, the severed sheet portion is severed simultaneously at multiple locations across the width of the sheet as compared to those devices requiring the sheet to be torn from one edge of the sheet and then across the width of the sheet to the opposite sheet edge.

Figure 8:
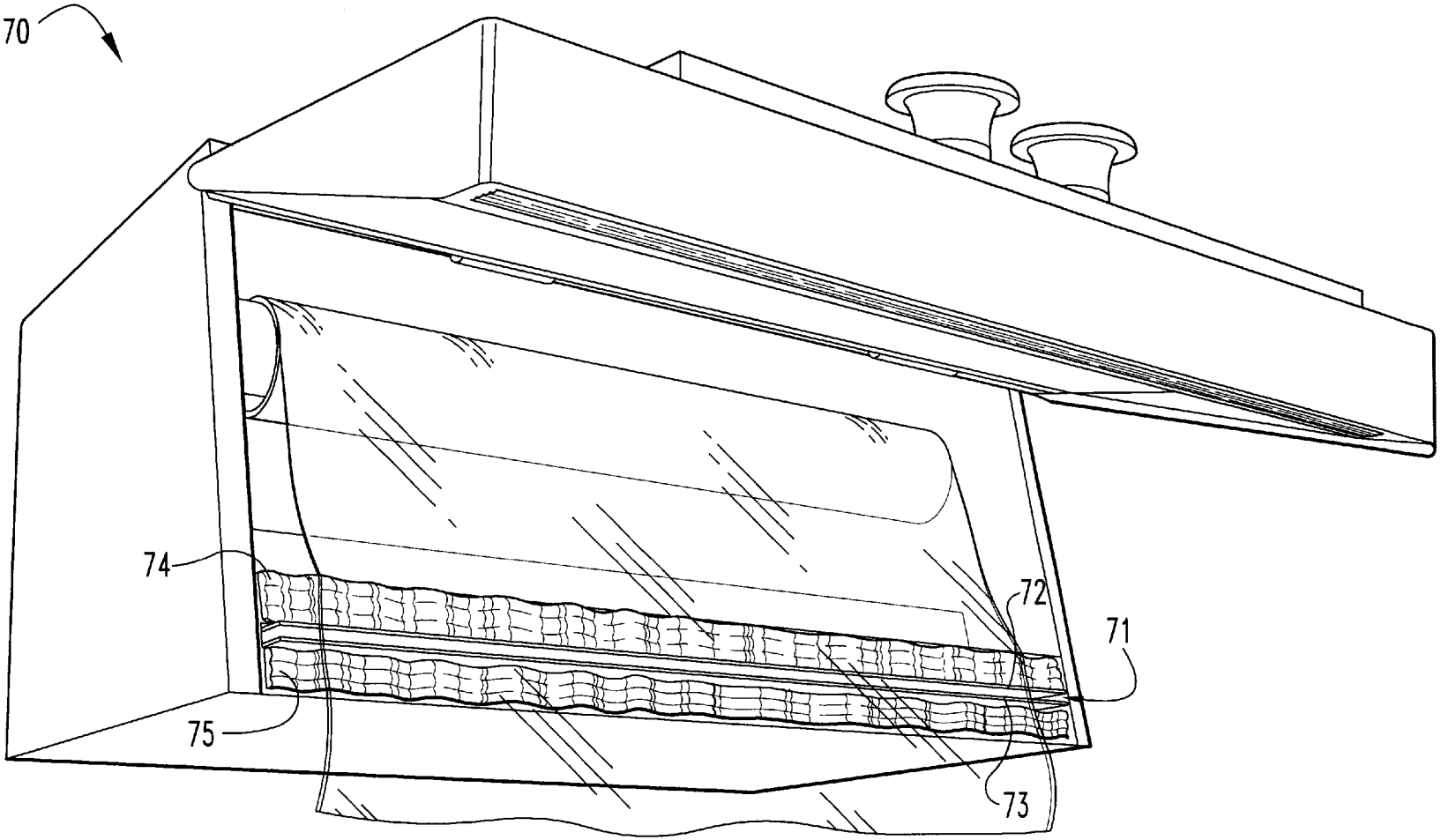
FIG. 8 is a perspective view of an alternate embodiment of the dispenser with the front wall in the open position.

An alternate embodiment of the dispenser is shown in FIG. 8. Dispenser 70 is identical to dispenser 10 with the exception of the design of the anvil against which the flexible sheet rests as the front wall is swung down and the blade pierces the sheet. The anvil is identical to the anvil previously described with the exception that the design of FIG. 8 does not include the second pair of edges 38–39 of FIG. 6. Thus, dispenser 70 includes a slot 71 into which the cutting blade previously described is extendable. A first pair of edges 72 and 73 are spaced apart and extend on the opposite sides along the length of slot 71 having outer roughened distal ends. A pair of resilient strips 74 and 75 are mounted outwardly of and adjacent respectively edges 72 and 73 and extend along the length of slot 71. As the pressure plate attached to the front wall of dispenser 70 is swung downward, the resilient outer surface of the pressure plate compresses against edges 72 and 73 and resilient strips 74 and 75 preventing the sheet 50 from slipping when it is penetrated by the points of the cutting blade and severed as the cutting blade is pressed further into slot 71. The distal ends of edges 72 and 73 extend outwardly of strips 74 and 75 in a manner identical to the extension of distal ends 48–49 of edges 36–37 relative to resilient spacers 42–43.

The method of storing a roll of thin plastic sheet having width on a roll and allowing a portion of the sheet to be severed by a blade while on a stop surface includes the steps of holding a roll of thin plastic sheet, pulling a portion of the sheet from the roll, positioning the pulled portion against a stop surface while it remains attached to the roll, moving a blade toward the pulled portion while the portion remains on the stop surface, contacting the pulled portion with the blade across simultaneously the width thereof and forcing the blade through the pulled portion across simultaneously the width thereof severing the portion from the roll. The portion to be removed from the roll is held on the stop surface during the contacting and forcing steps and is placed in tension during the steps. In the dispenser disclosed herein the method includes pivoting the blade toward the stop surface until the blade contacts the portion of the sheet to be removed.

While the foregoing has described the present invention and the advantageous it presents over currently available devices for dispensing materials for wrapping and storing perishable items, it will be apparent to those skilled in the art that changes and some modifications may be made without departing from the spirit of my invention or the scope of my invention as defined herein.

What is claimed is:

1. A combination of:

a first roll of flexible sheet with width; and a dispenser to hold said roll and dispense portions of said sheet, said dispenser including a housing with a slot extending thereacross and a cover movably mounted to said housing;

a mount on said housing removably holding said roll;

a pair of spaced apart edges having a length and mounted to said housing against which said sheet is positioned when unwound from said roll, said slot positioned between said edges and extending widthwise across said sheet positioned thereagainst; and, a pair of resilient strips that are discrete from said pair of spaced apart edges, said strips mounted to said housing and extending said length of said edges, said edges being positioned between said resilient strips to resiliently receive sheet positioned thereacross and therebetween; and, a blade mounted on said dispenser, said slot sized to receive said blade therein once said blade pierces said sheet with said blade movable toward said edges and strips trapping said sheet between said blade and said edges and said strips piercing said sheet at multiple locations simultaneously across said width allowing removal of portions therefrom.

2.The combination of claim 1 and further comprising:

a spring biased plate positioned adjacent said blade and mounted with said blade to allow relative motion therebetween with said plate movable against said sheet positioned against said pair of edges and said pair of resilient strips holding said sheet fixedly thereon while said blade moves against said sheet placing said sheet in tension and piercing said sheet and moving into said slot;

said edges having ends which extend outwardly of said strips.

3. The combination of claim 2 wherein:

said blade includes a plurality of pointed ends extendable through said plate contacting and piercing in multiple locations across said sheet held by said plate, said edges and said strips.

4. The combination of claim 3 and further comprising:

a roll of metallic sheet held by said mount, said roll of metallic sheet is positioned a greater first distance aft of said edges than said first roll but a less second distance, perpendicular to said first distance, from said edges than said first roll allowing said metallic sheet to extend to said edges under said first roll which has plastic sheet wound thereon.

5. The combination of claim 4 wherein said dispenser has a frame with said mount, said edges, said strips and said slot provided thereon; and, a wall pivotally mounted to said frame with said blade and said plate mounted thereon so said plate and said blade swing toward said slot to allow said plate to hold said sheet placed on said edges and said strips while said blade pierces same.

6. The combination of claim 5 and further comprising:

a spring positioned relative to said plate and said wall normally forcing said plate outwardly therefrom recessing said blade with said plate initially contacting said sheet on said edges without contact by said blade against said sheet on said edges until said wall is forced further toward said edges with said spring yielding allowing said blade to project outwardly from said plate piercing said sheet on said edges.

7. The combination of claim 6 and further comprising:

a first pair of roughed edges extending along said slot with said slot therebetween;

a second pair of roughed edges extending along said slot with said first pair of roughed edges positioned between said second pair of edges, said first pair of edges project outwardly a greater distance from said slot than said second pair of edges; and, resilient material positioned between said first pair of roughed edges and said second pair of roughed edges and on said plate to resiliently receive sheet positioned thereacross and therebetween, said resilient material on said plate first contacts said first pair of roughed edges and upon further movement contacts said second pair of roughed edges placing said sheet thereon in a tensioned state to be engaged by said blade.

8. A device for holding a roll having a flexible sheet with a width and for piercing said sheet to dispense a piece of sheet from the roll comprising:

a holder for removably holding a roll having a flexible sheet wound thereon:

a sheet support having a pair of edges and a pair of resilient strips separate from said edges with said edges and said strips extending lengthwise together and against which said sheet is positioned against once unrolled from said roll but still attached to said roll; and, a blade movable toward said sheet on said pair of edges and said pair of resilient strips to contact said sheet simultaneously across the width of said sheet to pierce it and dispense a piece therefrom, and wherein:

said holder includes a first frame with said holder and said sheet support provided thereon, and a second frame swingably mounted to said first frame and said blade mounted on said second frame, said second frame movable with said blade toward said edges to allow said blade to pierce said sheet.

9. The device of claim 8 wherein:

said pair of edges are positioned between said pair of resilient strips, said pair of edges distal ends that extend outwardly of said strips.

10. The device of claim 9 wherein:

said holder includes a spring biased plate mounted on said second frame normally recessing said blade with said plate contacting and holding said sheet against said edges while further movement of said second frame causes said blade to project from said plate and through said sheet.

* * * * *